United States Patent [19]

Pearl

[11] Patent Number: 5,049,103

[45] Date of Patent: Sep. 17, 1991

[54] BUBBLE TOY NECKLACE

[76] Inventor: Louis Pearl, P.O. Box 436, Sausulito, Calif. 94965

[21] Appl. No.: 650,300

[22] Filed: Feb. 4, 1991

[51] Int. Cl.[5] ..... A63H 33/28

[52] U.S. Cl. ..... 446/19; 446/27

[58] Field of Search ..... 446/19, 15, 26, 27, 446/28, 20

[56] References Cited

U.S. PATENT DOCUMENTS

| | | | |
|---|---|---|---|
| 1,021,323 | 3/1912 | McMurtry | 446/15 X |
| 4,166,336 | 9/1979 | Smith | 446/19 |

FOREIGN PATENT DOCUMENTS

| | | | |
|---|---|---|---|
| 182995 | 1/1955 | Austria | 446/16 |
| 2316497 | 4/1974 | Fed. Rep. of Germany | 446/15 |
| 7645 | 4/1895 | United Kingdom | 446/20 |
| 701299 | 12/1953 | United Kingdom | 446/20 |
| 932944 | 7/1963 | United Kingdom | 446/16 |

OTHER PUBLICATIONS

Louis Pearl, "Sudman's Bubble-ology Guide", 1984, Nine (9) pages.

"bauble of Bubbles", Sunrise, Inc., *The Toy Book,* Dec. 1990, p. 5.

*Primary Examiner*—Mickey Yu

*Attorney, Agent, or Firm*—Laurence J. Shaw

[57] ABSTRACT

A complete bubble blowing assembly which can be worn as a necklace. A small bubble horn capable of producing large bubbles is attached as an ornament to a necklace cord. A vial for containing bubble solution may be removably attached to the horn for transportation. During bubble blowing play the vial is separated from the horn so that the horn can be dipped into the bubble solution, priming the horn for bubble blowing. The lid of the vial can be attached to the bottom of the vial providing a stable base for the vial and preventing loss of the lid during play.

11 Claims, 1 Drawing Sheet

BUBBLE TOY NECKLACE

BACKGROUND

1. Field of Invention

This invention relates to bubble blowing toys. In particular this invention relates to bubble blowing toys which are attached as an ornament to a necklace for ease of transportation, and which have a soap solution container which is removably attachable to the bubble toy.

2. Discussion of Prior Art

Bubble toys which are attached as an ornament to a necklace have previously consisted of a vial for holding bubble solution, and a cap for the vial with a bubble wand protruding from the inside of the cap; the top of the cap is attached to the necklace. The bubble wand is essentialy a closed loop at the end of a stick. Although these necklace bubble toys are attractive and portable, because they utilize the traditional bubble wand they have limited bubble blowing capabilities.

Horn shaped bubble blowers, such as the one described in U.S. Pat. No. 4,166,336, are capable of producing large bubbles for their size since a relatively large amount of bubble solution is retained on the broad lip and interior surface at the exhaust end of the horn. The bubble blower described in the aforementioned patent also makes it easy to blow bubbles upwards, downwards, or to the sides. The design also minimizes the flow of bubble solution to the mouthpiece.

CROSS REFERENCE TO DISCLOSURE DOCUMENT

The present invention was disclosed to the Patent and Trademark Office as Disclosure Document #269,223.

SUMMARY OF THE INVENTION

This invention seeks to provide a complete bubble blowing assembly which can be worn as an ornament on a necklace and can blow large bubbles. The invention also seeks to provide such a bubble toy which is convenient and pleasant to transport and use.

It is therefore an object of this invention to provide a bubble blowing assembly which can be worn as an ornament on a necklace.

It is another object of the invention to provide a small bubble blowing necklace toy which can produce large bubbles.

It is another object of the invention to provide a bubble blower which will prevent bubble solution from being accidentally sucked into the mouth.

It is another object of this invention to provide a small bubble blower which hangs from a necklace in a fashion which minimizes the accumulation of bubble solution on the mouthpiece during play.

It is another object of this invention to provide a bubble solution vial which can be removably attached to the bubble blower for ease of transportation of the bubble solution while wearing the assembly as a necklace.

It is another object of this invention to provide a means by which the lid of the bubble solution vial can be removably attached to the bottom of the vial. When the lid is attached to the bottom of the vial it is to provide a stable base for the vial.

These and other objects of the invention will become more apparent and will be better understood with reference to the subsequent detailed description considered in conjunction with the accompanying drawings.

DETAILED DESCRIPTION OF THE INVENTION

Figure 1:
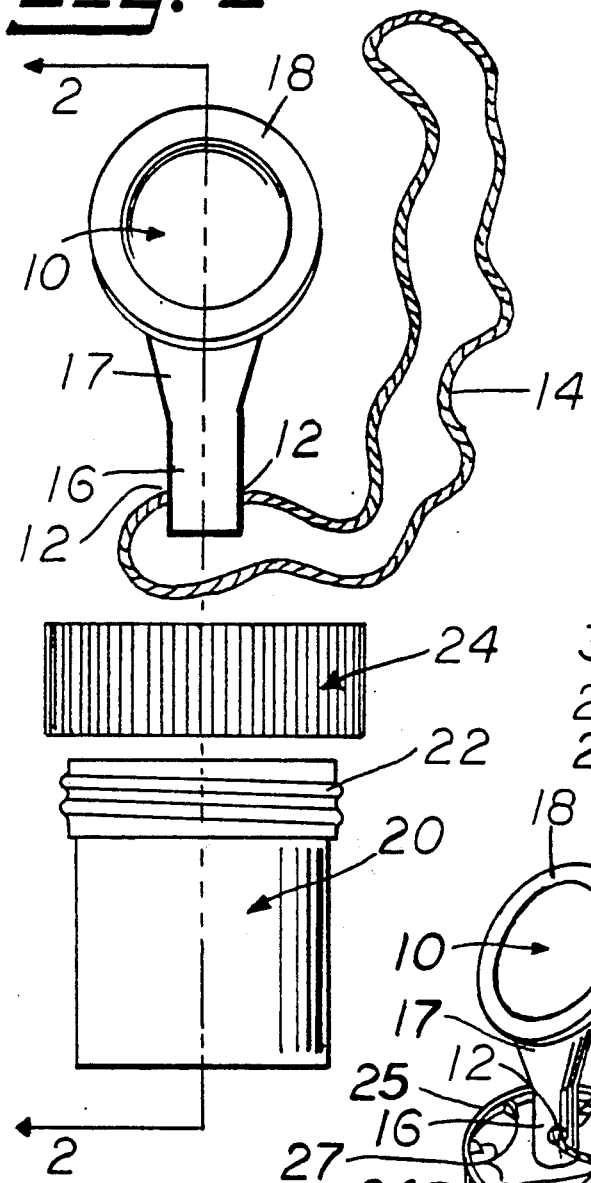
FIG. 1 presents side views of the bubble horn and necklace cord, the lid, and the bubble solution vial.

Referring to FIG. 1, the bubble toy necklace consists of a bubble horn 10, a necklace cord 14, a bubble solution vial 20, and a lid for the bubble solution vial 24. The horn 10, vial 20 and lid 24 are made of plastic. The bubble horn 10 is roughly funnel shaped and is comprised of a mouthpiece 16 and an exhaust section 17. The horn 10 has a circular cross-section over most of its length. The mouthpiece 16 is substantially a hollow cylinder, and the exterior of the exhaust section 17 is frusto-conical with a ring shaped lip 18 at the exhaust end 17 opening. The plane of the lip 18 forms an acute angle with the longitudinal axis of the bubble horn 10. The bubble horn 10 has a total length of 3¾" and a width of 1 7/32". The narrow end of the mouthpiece 16 has a width of 0.42".

The necklace cord 14, which is approximately three feet in length, passes through a pair of small holes 12 in the mouthpiece 16 of the bubble horn 10. The axis of the holes 12 is transverse to the longitudinal axis of the horn 10. The cord 14 is long enough that while the horn 10 is being worn around the neck the mouthpiece 16 can be brought to the mouth to blow bubbles. The holes 12 are located to the mouthpiece 16 end of the center of gravity of the horn 10. Therefore the horn 10 hangs from the necklace cord 14 with the exhaust end 17 down. During play this prevents bubble solution from flowing to the mouthpiece 16 and entering the mouth when bubbles are blown.

The bubble solution vial 20 is cylindrical with a height of about 2.125" and an outer diameter of about 1.375". The exhaust section 17 of the bubble horn 10 may be immersed into bubble solution retained in the vial 20. If the user accidentally sucks on the mouthpiece 16 while the exhaust section 17 is immersed in the bubble solution, the holes 12 prevent the suction from being sufficient to draw bubble solution into the mouth. Upon removing the bubble horn 10 from the solution, a film of bubble solution will span the opening at the end of the exhaust section 17. By gently blowing into the mouthpiece 16 a bubble will form, and with a quick fluid motion of the horn 10 substantially in the plane of the lip 18, the bubble will be freed from the horn 10 to float away.

The advantages of a bubble horn 10 of this type are discussed at length in U.S. Pat. No. 4,166,336, and will only be summarized in this paragraph. Since the plane of the lip is at an acute angle to the longitudinal axis of the horn 10, the horn 10 can simply be rotated around its longitudinal axis to change the angle at which the bubble is directed. The extra surface area provided by the lip 18 allows a relatively large amount of bubble solution to be retained on the horn 10, and therefore relatively large bubbles to be blown. The baffle 15, shown in FIG. 2, inhibits bubble solution from flowing along the interior of the exhaust section 17 to the mouthpiece 16 and entering the mouth of the user.

Threads 22 at the top of the vial 20, and threads 28 inside the lid 24 (see FIG. 2) allow the lid 24 to be screwed onto the top of the vial 20. A flange 29 extending downwards from the underside of the lid 24 helps provide a good seal when the lid 24 is screwed onto the vial; the distance from the flange 29 to the threads 28 is approximately equal to the thickness of the top of the vial 20. Two small ridges 30 between the flange 29 and the threads 28 also contribute to the seal by contacting the upper surface of the vial 20. The outer sides of the lid 24 are fluted to provide friction for gripping and twisting even if coated with slippery bubble solution.

Figure 2:
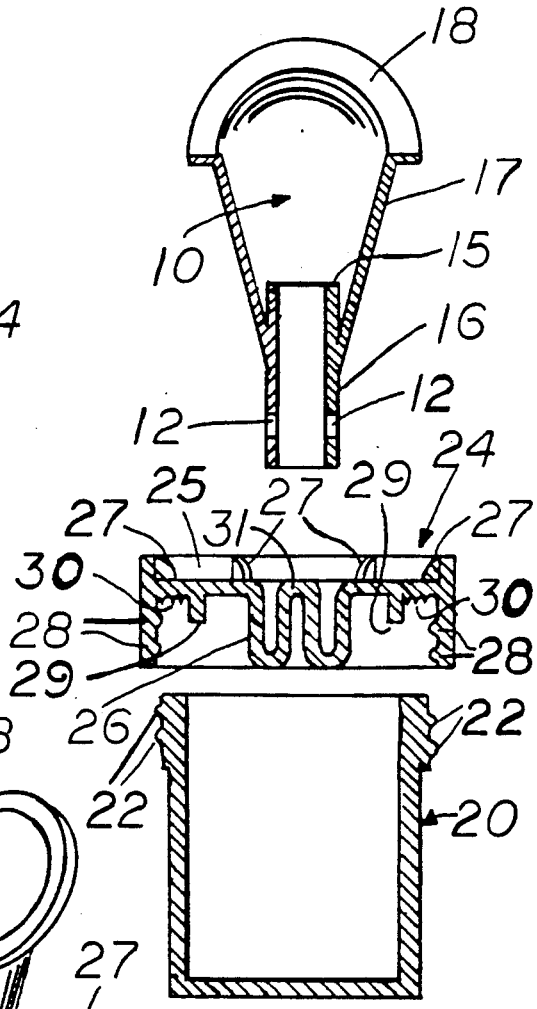
FIG. 2 is a sectional view of the bubble horn, the lid, and the bubble solution vial taken along line 2—2 of FIG. 1.
Figure 3:
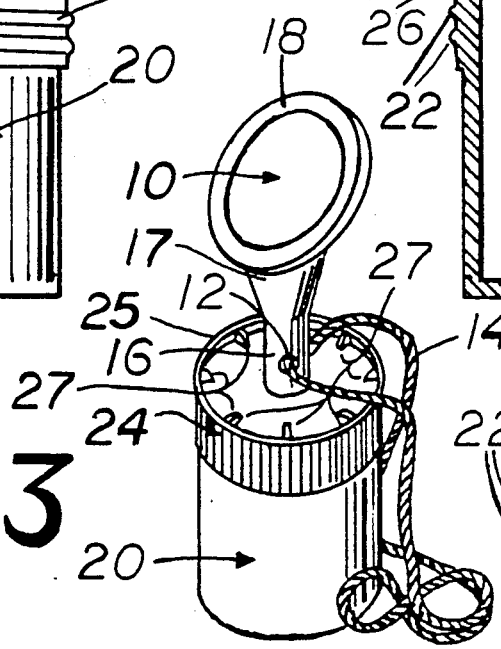
FIG. 3 is a perspective view of the bubble toy assembly ready for wear as a necklace; the bubble horn is engaged to the lid and the lid engaged to the bubble solution vial.

Referring now to FIG. 2 it is seen that there is a circular well 26 in the center of the lid 24. The exterior dimensions of a protrusion 31 in the center of the well 26 are substantially equal to the interior dimensions of the end of the mouthpiece 16 of the bubble horn 10. Therefore the bubble horn 10 can be removably secured by friction to the lid 24 by pushing the mouthpiece 16 into the well 26. When the horn 10 is affixed to the lid 24, and the lid 24 is screwed onto the vial 20, as is shown in FIG. 3, the entire assembly can be worn by placing the necklace cord 14 around the neck. This provides an easy mode of transportation of all the components of the bubble toy. The various components of the toy can be brightly colored to produce a playful attractive appearance to the necklace assembly.

Figure 4:
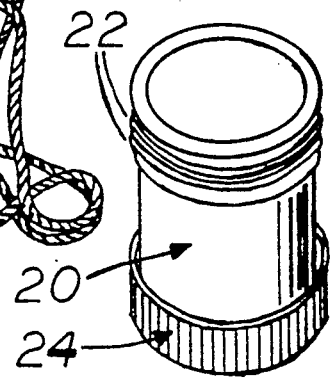
FIG. 4 is a perspective view of the bubble solution vial with the lid of the vial engaged to the bottom of the vial.

There is a vertical flange 25 along the top edge of the lid 24. There are eight vertical ribs 27 equally spaced along the inside edge of the flange 25. The distance between diametrically opposed ribs 27 is equal to the width of the bottom of the vial 20. This allows the top of the lid 24 to be removably secured by friction to the bottom of the vial 20, as shown in FIG. 4, by pressing the bottom of the vial 20 into the space between the ribs 27. Attaching the lid 24 to the vial 20 prevents the lid 24 from getting lost during play; the vial/lid 20/24 assembly can be held with one hand and the bubble horn 10 can be held with the other.

Thus, it will be seen that the improvements presented herein, consistent with the objects of the invention for the Bubble Toy Necklace, provide a bubble toy which can be worn as an ornament on a necklace, can produce large bubbles, has a bubble solution vial 20 which can be removably attached to the bubble horn 10, minimizes the accumulation of bubble solution on the mouthpiece 16, prevents bubble solution from being sucked up into the mouth of the user, and prevents the loss of the lid 24 of the bubble solution vial 20 during play.

While the above description contains many specificities, these should not be construed as limitations on the scope of the invention, but rather as exemplifications of preferred embodiments thereof. Many other variations are possible. For example, although plastic is the preferred material of construction for the toy, other materials such as wood or metal may be used. The horn 10, lid 24 and vial 20 may have different sizes and dimensions than those presented here. The horn 10 may have a polygonal or ellipsoidal cross-section. The bubble solution vial 20 may be non-cylindrical in shape. The necklace cord 14 may be attached to the horn 10 in any number of ways.

Accordingly, the scope of the invention should be determined not by the embodiments illustrated, but by the appended claims and their legal equivalents.

Having thus described the invention, what is desired to be protected by Letters Patent is presented by the following appended claims.

What is claimed is:

1. A bubble toy comprising:

(a) an elongated substantially funnel shaped blowing horn having a passage therethrough from a narrower mouthpiece end to a wider bubble forming end;

(b) a necklace cord, said horn being attached to said cord so as to permit said horn to be worn as a necklace;

(c) a bubble solution vial, the mouth of said vial being large enough to allow insertion of the bubble forming end of said horn into said vial in order to prime said horn for bubble blowing;

(d) a lid for said vial, said lid being removably mountable on said vial so as to seal bubble solution inside said vial; and (e) a first means for removably attaching said horn to said lid so as to allow said vial, said lid, said cord, and said horn to be transported as a single unit when said lid is mounted on said vial and said horn is attached to said lid by said first means.

2. The bubble toy of claim 1 wherein said first means for removably attaching said horn to said lid is a well in said lid of such dimensions that said horn is secured by friction in said well when a section of said horn is inserted into said well.

3. The bubble toy of claim 2 wherein said section of said horn is a portion including the mouthpiece end of said horn.

4. The bubble toy of claim 3 wherein a lip extends outwards at the termination of the bubble blowing end of said horn, said lip being substantially planar and laying at an acute angle to the longitudinal axis of said horn.

5. The bubble toy of claim 1 further comprising a second means for removably attaching said lid to the bottom of said vial so that during play said lid will not be misplaced.

6. The bubble toy of claim 5 wherein when said lid is engaged to said vial the lower surface of said lid is broad and substantially planar so as to provide a stable base for said vial.

7. The bubble toy of claim 6 wherein said second means is a flange on the top of said lid, inside dimensions of said flange being substantially equal to dimensions of the bottom of said vial, so that friction will secure said flange to said vial when the bottom of said vial is inserted into said flange.

8. The bubble toy of claim 7 wherein a lip extends outwards at the termination of the bubble blowing end of said horn, said lip being substantially planar and laying at an acute angle to the longitudinal axis of said horn.

9. The bubble toy of claim 1 wherein said cord is attached to said horn between the center of gravity of said horn and the mouthpiece end of said horn so that said horn will hang from said cord with the mouthpiece end pointing upwards to prevent bubble solution from flowing to the mouthpiece end of said horn.

10. The bubble toy of claim 9 wherein said cord passes through a transverse bore in said horn.

11. The bubble toy of claim 10 wherein a lip extends outwards at the termination of the bubble blowing end of said horn, said lip being substantially planar and laying at an acute angle to the longitudinal axis of said horn.

* * * * *